US007780576B1

(12) United States Patent
Sudeith et al.

(10) Patent No.: US 7,780,576 B1
(45) Date of Patent: Aug. 24, 2010

(54) FITNESS SYSTEM FOR CLIMBING WALLS

(75) Inventors: Timothy S. Sudeith, Mendota Heights, MN (US); Kevin Sudeith, Mendota Heights, MN (US); Lyle Helke, Mendota Heights, MN (US); John Kidd, Mendota Heights, MN (US)

(73) Assignee: Everlast Climbing Industries, Inc., Mendota Heights, MN (US)

( * ) Notice: Subject to any disclaimer, the term of this patent is extended or adjusted under 35 U.S.C. 154(b) by 92 days.

(21) Appl. No.: 12/221,381

(22) Filed: Aug. 1, 2008

Related U.S. Application Data

(60) Provisional application No. 60/962,832, filed on Aug. 1, 2007.

(51) Int. Cl.
*A63B 9/00* (2006.01)
*A63B 21/04* (2006.01)

(52) U.S. Cl. ..... 482/37; 482/51; 482/129; 482/904

(58) Field of Classification Search ..... 482/23, 482/35–37, 51, 52, 92, 96, 121, 129, 130, 482/142, 904
See application file for complete search history.

(56) References Cited

U.S. PATENT DOCUMENTS 5,092,587 A * 3/1992 Ulner et al. ..... 482/37
5,254,058 A 10/1993 Savigny
5,732,954 A * 3/1998 Strickler et al. ..... 273/441
5,823,925 A * 10/1998 Webster et al. ..... 482/129
5,944,634 A 8/1999 Neves
6,074,327 A 6/2000 Franklin
6,083,142 A 7/2000 Wilson
6,231,482 B1 5/2001 Thompson
D478,145 S * 8/2003 Byrd et al. ..... D21/826
D496,088 S * 9/2004 Byrd ..... D21/827
7,056,266 B2 * 6/2006 Sudeith ..... 482/37
7,381,154 B1 * 6/2008 Sudeith et al. ..... 482/37
7,419,457 B1 * 9/2008 Sudeith et al. ..... 482/37
7,520,838 B1 * 4/2009 Sudeith et al. ..... 482/37
2002/0019297 A1 2/2002 Vettori
2005/0192160 A1 * 9/2005 Sudeith et al. ..... 482/37
2005/0245355 A1 11/2005 Brewer et al.

FOREIGN PATENT DOCUMENTS

DE 29919894 U1 * 5/2000
DE 102004030217 A1 * 12/2005
DE 202006002456 U1 * 5/2006
DE 102005017145 A1 * 10/2006
JP 10277189 A * 10/1998

* cited by examiner

*Primary Examiner*—Loan Thanh
*Assistant Examiner*—Victor K Hwang
(74) *Attorney, Agent, or Firm*—Anthony G. Eggink; Katrina M. Eggink

(57) ABSTRACT

A resistance tubing fitness system and method for climbing walls. The system and method provides a plurality of cooperating components which permit a user to enhance workout activities at a climbing wall. The system may include a guide, instruction cards, resistance bands, handles and hand holds designed to receive a resistance band, step holds and usage and safety instructions. In use, students may perform lateral raises, bicep curls, step-ups and other exercises at designated workout stations at the climbing wall.

20 Claims, 5 Drawing Sheets

FITNESS SYSTEM FOR CLIMBING WALLS

BACKGROUND OF THE INVENTION

This application claims the benefit of U.S. Provisional Application Ser. No. 60/962,832, filed on Aug. 1, 2007.

The present invention relates generally to a fitness system and method for climbing walls. Particularly, the invention relates to a fitness system and method which includes a plurality of cooperating work out activity components constructed for use with a climbing wall. More particularly, the invention relates to a fitness system and method which uses resistance tubing and cooperating hold structures on a climbing wall.

Applicants' assignee is the owner of U.S. Pat. No. 7,056,266 entitled Climbing Wall Assembly, issued on Jun. 6, 2006 and which is incorporated by reference herein. The '266 Patent discloses climbing wall panels having a pattern of mounting apertures for receiving handholds and relates climbing wall elements. The fitness system of the present invention provides exercise structures to transform a climbing wall into dynamic workout stations and to increase cardiovascular endurance, muscle strength and flexibility to the user.

In addition to the benefits derived from use of the climbing walls, the fitness system and method of the present invention provide resistance tubing and other structures to enhance workout activities at and on a climbing wall.

SUMMARY OF THE INVENTION

The fitness system of the present invention comprises a plurality of cooperating components which permit a user to enhance workout activities at and on a climbing wall. The fitness system may include a fitness guide, instructional workout cards, means to display the workout cards, resistance bands with handles, step holds and hand holds designed to receive the resistance band.

Utilizing the method of the invention, students, for example, may perform lateral raises, bicep curls, step-ups and other exercises at designated stations in accordance with instructional information on the workout cards.

It is a benefit of the present invention to provide a system for use with a climbing wall to provide workout stations to increase cardiovascular endurance, muscle strength and flexibility of a user. It is another benefit of the present invention to provide a hand hold which can receive a resistance band. It is another benefit of the present invention to use each panel of a climbing wall as a separate fitness station, for example, in a school, in a university physical education setting or at a health club. It is another benefit of the invention to provide a method of using a climbing wall for providing dynamic work out stations.

These and other benefits and advantages of this invention will become clear from the following description by reference to the drawings.

DESCRIPTION OF THE PREFERRED EMBODIMENTS

Figure 1:
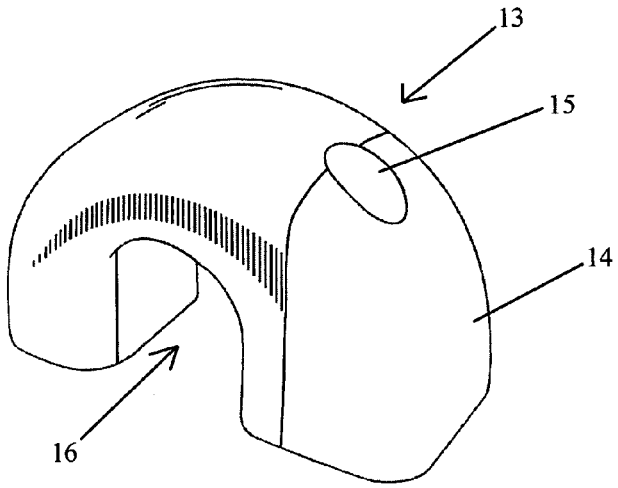
FIG. 1 is a perspective view of a handhold for mounting to a climbing wall and constructed to receive a resistance band structure.

The fitness system of this invention is comprised of various cooperating components for use with climbing walls. The individual components are shown in the drawings and include force resistance bands with handles, U-shaped hand holds for capturing the resistance bands, step holds, a fitness guide and a plurality of instructional workout cards. As shown, the resistance band hand holds and step holds are provided with apertures for mounting the respective hold bodies to a climbing wall for use in the system and method of the invention.

Figure 2:
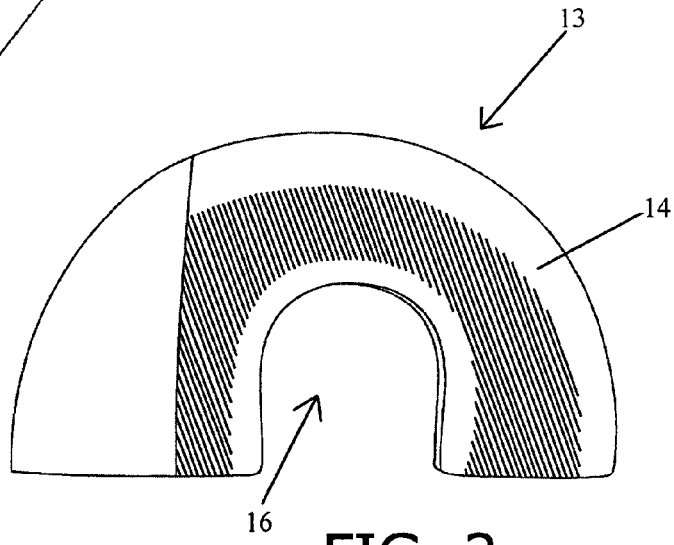
FIG. 2 is a lateral view of the handhold of FIG. 1.
Figure 3:
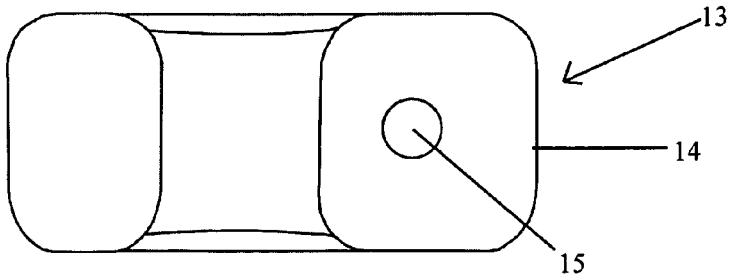
FIG. 3 is a bottom view of the handhold of FIG. 1.

Referring to FIGS. 1-3, a hand hold structure 13 is shown having a generally U-shaped body configuration 14. When the hand hold 13 is mounted on a climbing wall the U-shaped body configuration 14 forms an opening 16 with respect to the climbing wall surface to capture a resistance band. An aperture 15 is shown for receiving a fastener for fastening the hand hold 13 to a climbing wall, for example at a mounting aperture having a t-nut and contained in the climbing wall. The latter mounting apertures are shown and described in U.S. Pat. No. 7,056,266. As shown particularly in FIGS. 1 and 2, the shaded body portion has a smooth exterior for purposes of allowing the resistance band to move with respect thereto. The top, non-shaded portion where fastening aperture 15 is shown is preferably textured for purposes of allowing the hold 13 to be used for climbing purposes, for example, to provide gripping surfaces for the feet of a user.

Figure 4:
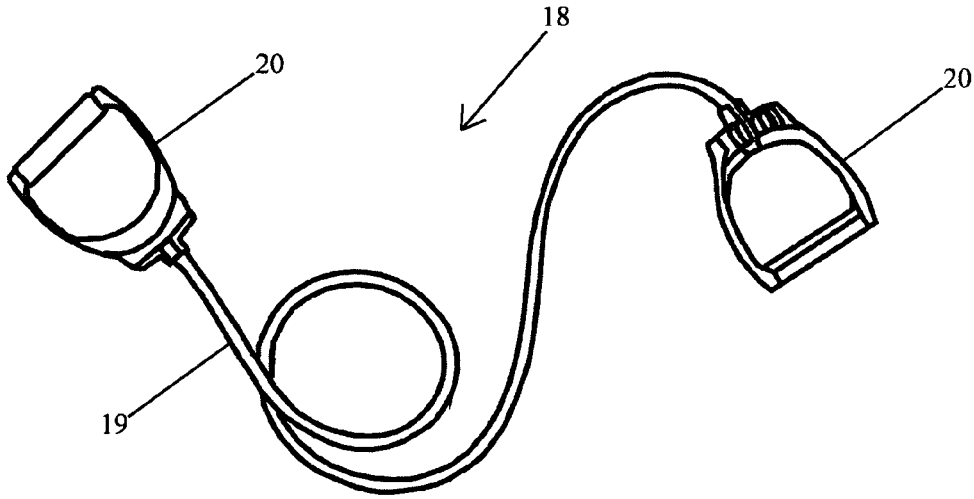
FIG. 4 is a perspective view of a resistance band structure of the fitness system of the invention.

Referring to FIG. 4, a resistance band 18 is shown having an elongated flexible body 19 and two handles 20 at each end. Elongated body 19 may be constructed of a flexible polymeric stretchable material and is constructed and arranged to extend through the opening 16 formed by the hold 13 and the climbing wall. The handles 20 are constructed and arranged to have a larger dimension than that of the opening so that the resistance band 18 remains in the opening. The handles may be removable from the band body 19 as described below, so that they may be removed and installed on a mounted hold 13.

Figure 5:
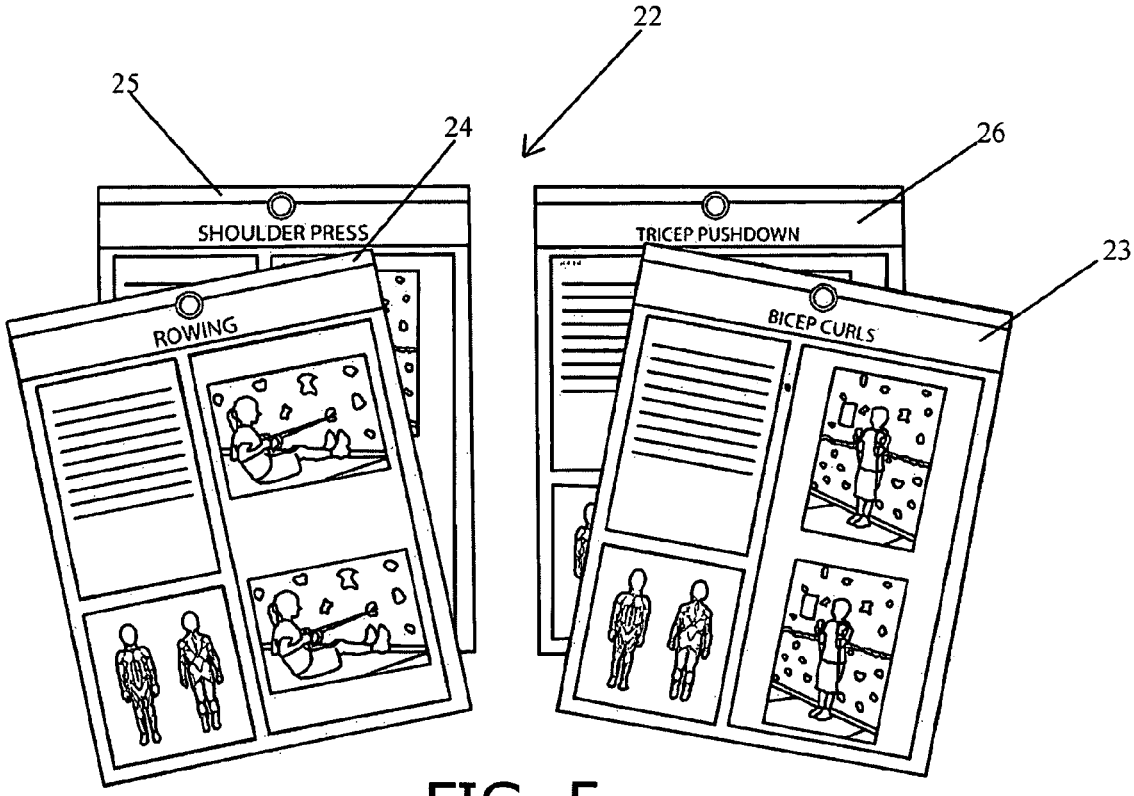
FIG. 5 is a perspective view showing the instructional workout cards of the invention.

Referring to FIG. 5, instruction cards or instruction guides 22 are shown and which illustrate various specified exercises for a user utilizing the various cooperating components of the fitness system. Instruction cards 23-26 describe and illustrate specific exercises, for example, bicep curls, rowing, shoulder presses and tricep pushdown, respectively. Although four instruction or instructional cards are shown, these cards are exemplary and additional cards are provided to set up associated workout stations on and at the climbing wall.

Referring to FIGS. 6-9, a step hold 27 is shown having a body 28 having an aperture 31 therethrough for mounting to a climbing wall, for example at a mounting aperture having a t-nut in a climbing wall. The step hold 27 is shown having a flat top surface 29, a curved side contour and a flat mounting surface 30 for contact with the climbing wall. The flat top surface 29 of the step hold 27 is constructed to be used as a step or a seat by a user of the fitness system and method of the invention.

Figure 10:
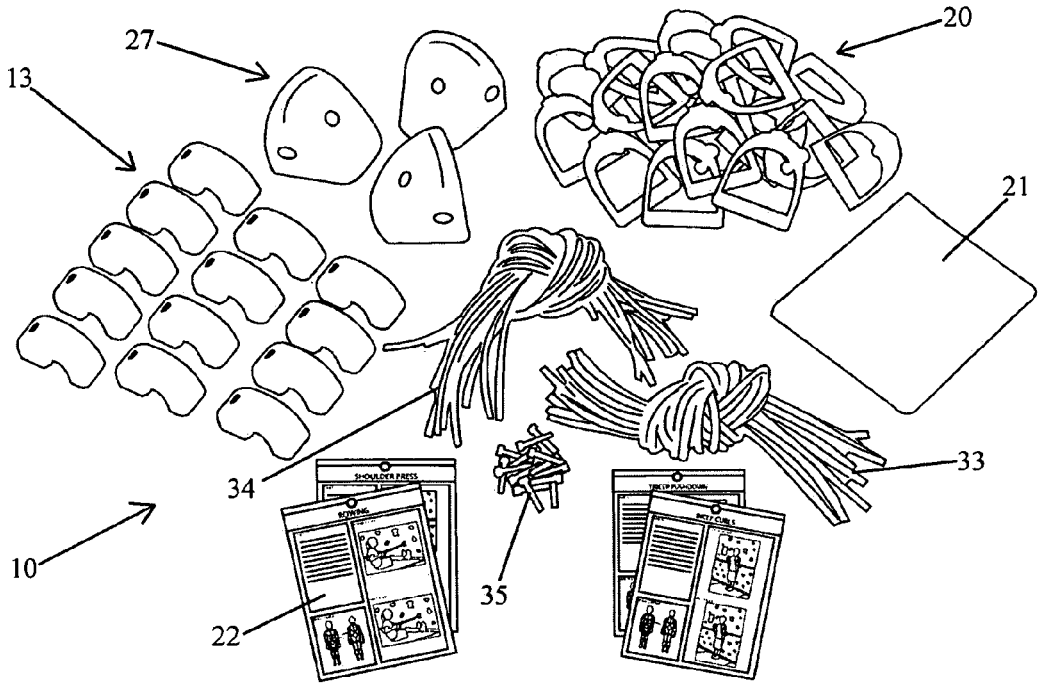
FIG. 10 shows the cooperating elements of the fitness system of the invention.
Figure 11:
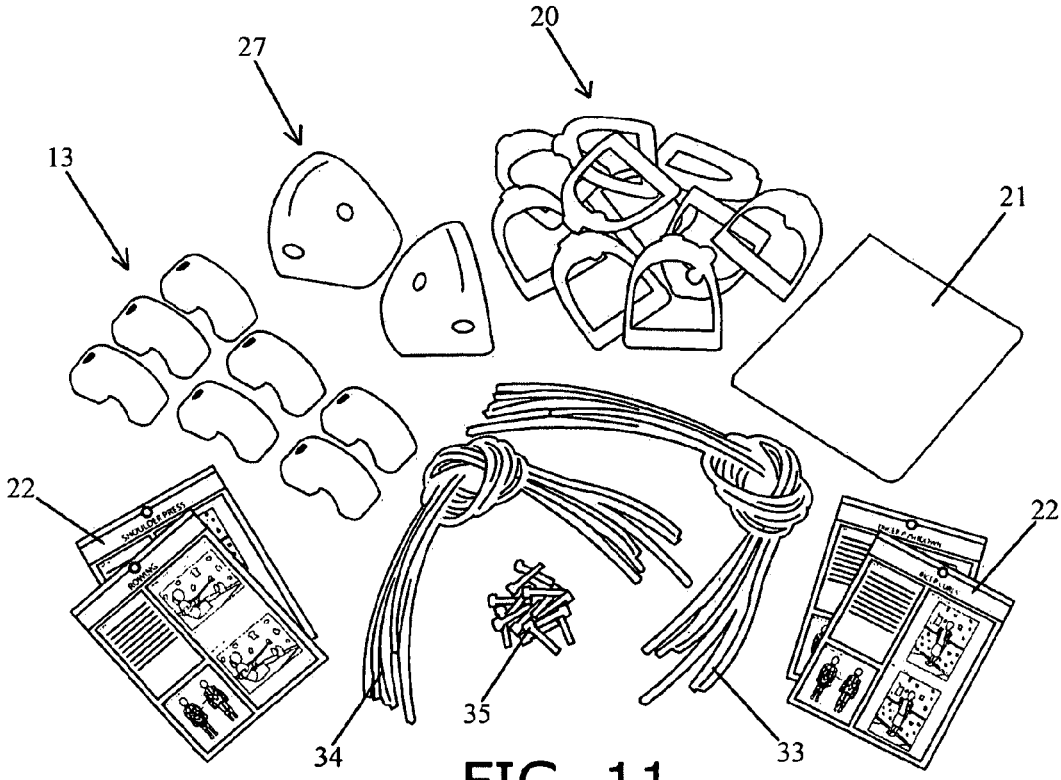
FIG. 11 also shows a plurality of cooperating elements of the fitness system used on a climbing wall.

Referring to FIG. 10, the cooperating components of the fitness system 10 are shown, for example, a fitness guide 21, eleven instruction cards 22, thirteen resistance band hand holds 13, three step holds 27, eleven easy strength resistance bands 33, eleven medium strength resistance bands 34 and eighteen handles 20 for the resistance bands. A plurality of plugs or fasteners 35 are shown and which are used to secure the handles 20 to the terminal ends of the force resistance tubes 33 and 34. A smaller set of elements is shown in FIG. 11 and which includes a fitness guide 21, eleven instruction cards 22, seven resistance band hand holds 13, two step holds 27, six easy strength resistance bands 33, six medium strength resistance bands 34 and ten handles 20 for the resistance bands. Fasteners or plugs 35 are also shown and which secure the handles 20 to the opposing ends of the resistance bands 33 and 34. The fitness guide 21 is provided to describe the various instructional cards, to provide instructions to set up the various workout stations and to provide safety instructions to the user.

Figure 12:
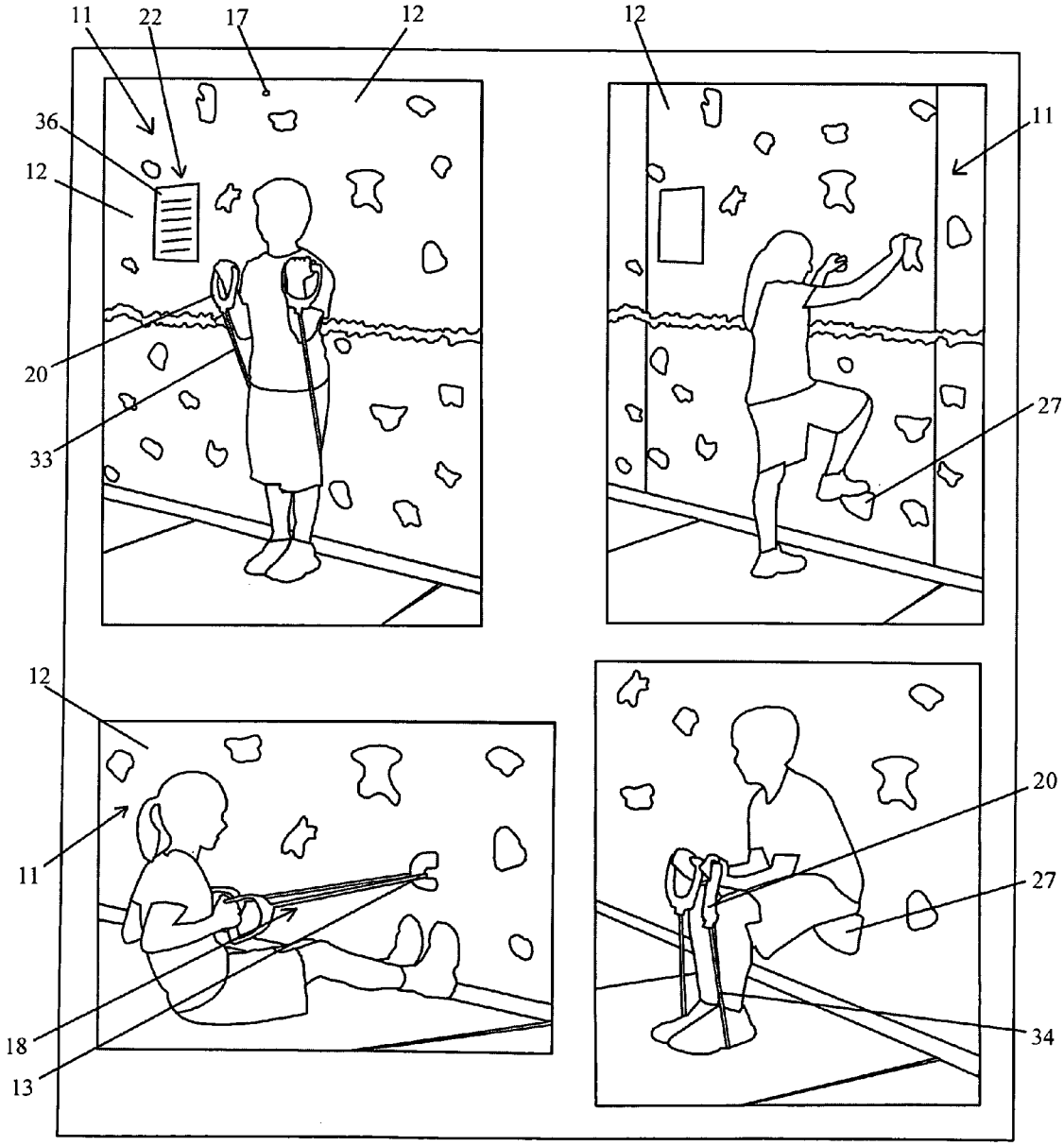
FIG. 12 shows the fitness system of the invention in use on four climbing wall panels.

In FIG. 12, users are shown using resistance band structures with specially designed hand holds and using the step hold to perform the exercises set forth on the instruction cards and fitness guide. Each user is shown at a specified wall panel 12 of climbing wall 11 and using the method steps of the invention for exercise purposes.

Referring further to the drawings, specially designed hand holds and step holds are mounted into the existing t-nut holes on the climbing wall using bolts to work on various stretches or strength training. The step holds are approximately 5½ inches in height. The hand holds have openings of varying sizes for the placement of resistance bands, tubes or any other device that could be used to create a stretching or strengthening station. For example, tubes may be used between two hand holds to create a pull-up or sit-up station. Resistance bands through another hold may be used for a bicep curl station. Since holds are easily mounted into t-nut holes, they can be easily moved and may vary in height to help work out certain muscle groups or to create a custom station designed for a certain height person, as shown in the drawings.

Figure 6:
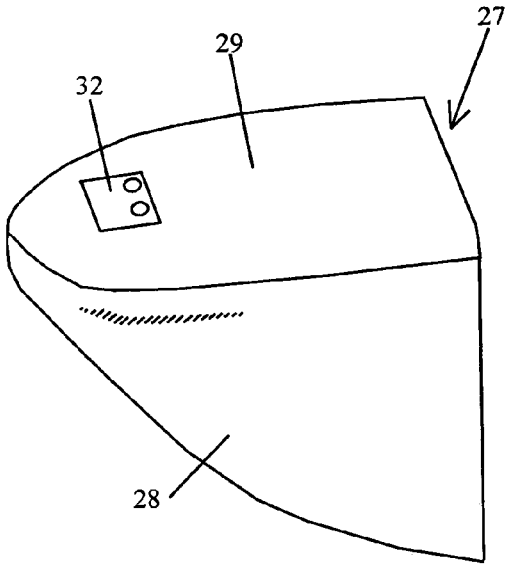
FIG. 6 is a perspective view showing the top and side of a step hold of the invention.
Figure 7:
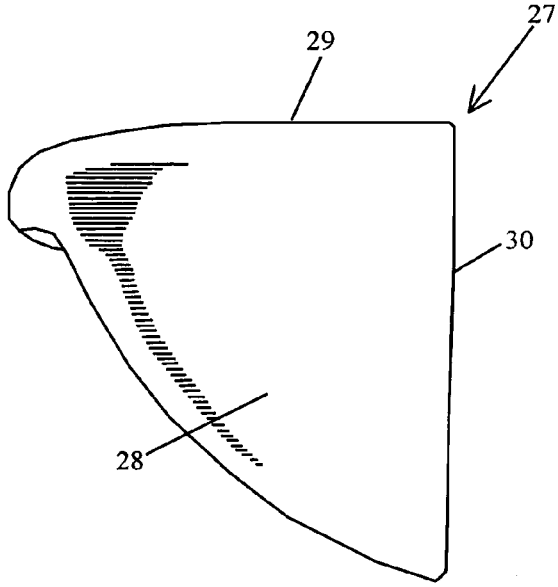
FIG. 7 is a side perspective view of the step hold of FIG. 6.
Figure 8:
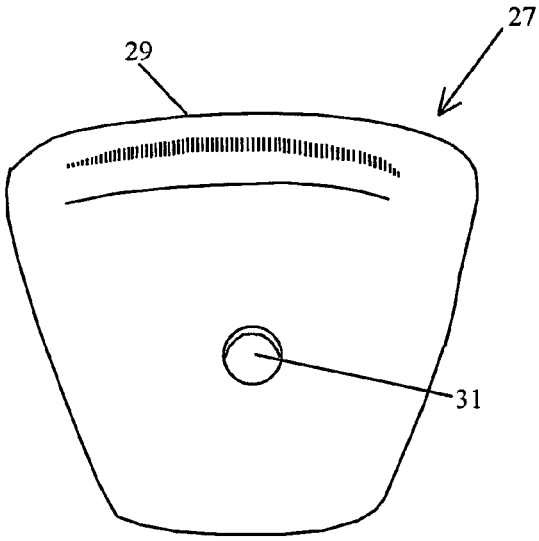
FIG. 8 is a frontal view of the step hold of FIG. 6.
Figure 9:
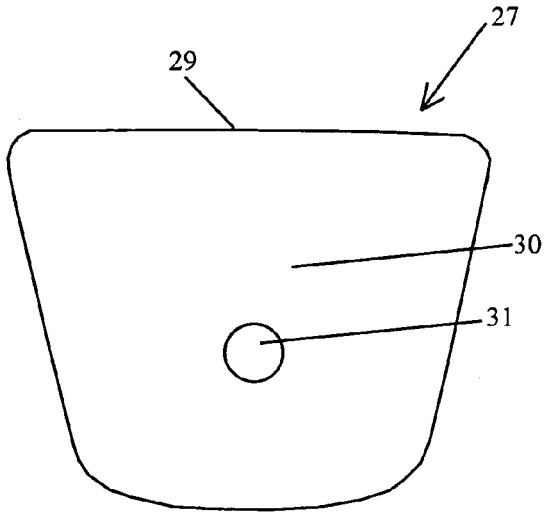
FIG. 9 is a rear view of the step hold of FIG. 6.

The holds can also be used in a step up/step down station and may include a built-in counter 32, as shown in FIG. 6, to maintain count of a person's total number of steps during an exercise session. Hand and step holds are preferably color coded to delineate difficulty level or to designate the workout of a certain muscle group. Holds may also include a timer or counter to help pace participants or to keep them at each station for a certain amount of time. Holds may also be provided with a clear window into which a card, for example an instruction card 22, can be placed to show the name of the station and instructions and illustrations/photos of the activity to be conducted there. The windows may be attached to or molded into the polymeric material of the hold. Alternatively, separate "word windows" 36 can be mounted using the t-nut holes 17 of the climbing wall adjacent the hold structures, as shown in FIG. 12. The clear envelope or windows provide means to identify a particular workout station and/or to provide instructions and illustrative photos of the particular exercises to be conducted.

As many changes are possible to the fitness system and method of the invention utilizing the teachings thereof, the descriptions above and the accompanying drawings should be interpreted in the illustrative and not in the limited sense.

That which is claimed is:

1. A workout system for providing workout activities on a climbing wall having spaced mounting apertures therein for receiving mounting fasteners to secure and mount a hand hold comprising:

a) a generally U-shaped hand hold structure mounted on the climbing wall, said generally U-shaped hand hold structure forming an opening with respect to the climbing wall;

b) a flexible polymeric force resistance band having terminal handle members, said band extending through said opening formed by said U-shaped hand hold structure and the climbing wall;

c) a fitness guide to instruct a user to locate said U-shaped hand hold structure on the climbing wall; and d) an instruction guide to illustrate to the user a specified workout routine designed to increase cardiovascular endurance, muscle strength and flexibility.

2. The system of claim 1, wherein a step hold is mounted to one said mounting aperture of said rigid climbing wall, said step hold having a generally flat top structure for use by a user in a workout activity.

3. The system of claim 2, wherein said rigid climbing wall has a plurality of wall panels and wherein said instruction guide provides a different workout activity at said wall panels.

4. The system of claim 3, wherein a pair of U-shaped hand holds are mounted spatially adjacent each other to create a pull-up or sit-up workout station.

5. The system of claim 3, wherein said plurality of panels provide exercises including lateral raises, bicep curls and step ups.

6. The system of claim 2, wherein a counter is incorporated into said step hold, said counter having a display showing the number of step exercises by the user.

7. The system of claim 2, wherein said U-shaped hand hold structure and said step holds are color coded to designate degree of difficulty.

8. The system of claim 7, wherein said hand hold structure and said step hold structure have a clear window wherein said instructional guide is placed.

9. The system of claim 7, wherein a clear window is placed on said climbing wall adjacent said hand hold and said step hold and wherein said instructional guide is positioned in said clear window.

10. The system of claim 1, including a plurality of resistance bands, each resistance band having a different resistance force.

11. A workout system for exercising using a climbing wall comprising:

a) a climbing wall having predetermined mounting apertures and comprised of a plurality of wall panels;

b) at least one hand hold each having a body with a generally U-shaped configuration and two spaced flat end portions for placement against said climbing wall so that when the hand hold is placed against the climbing wall for mounting, an opening is formed between the U-shaped body and the climbing wall;

c) at least one resistance band having an elongated body and handle members, said elongated body being flexible and for extension through said opening formed by said hand hold and said climbing wall; and d) a fitness guide having a plurality of exercises to perform utilizing said climbing wall, said at least one hand hold placed on said climbing wall and said resistance band extending through said opening formed by said climbing wall and said hand hold.

12. The system of claim 11, wherein said system further includes a plurality of instruction cards, each card having instructions of how to perform a specified exercise contained thereon.

13. The system of claim 11, wherein said system further includes at least one step hold having a body having a flat top surface.

14. The system of claim 11, wherein said handle of said resistance band has a width and wherein the opening formed by the hand hold body and the climbing wall has a diameter and wherein the width of said handle member is greater than the diameter of said opening.

15. The system of claim 11, wherein said resistance bands have various resistance levels.

16. A workout system for a climbing wall comprising:

a) a rigid climbing wall having spaced mounting apertures to secure and mount a climbing hold structure or a fitness related item thereto;

b) a generally U-shaped hold structure mounted to said climbing wall, said U-shaped hold structure forming an opening with respect to said climbing wall;

c) a separable, flexible and elastic force resistance band having terminal handle members extending through said opening formed by said U-shaped hold structure and said climbing wall;

d) a fitness guide describing a plurality of workout activities utilizing said force resistance band; and e) an instructional guide positioned near said U-shaped hold structure illustrating and describing a specified workout routine.

17. The workout system of claim 16, wherein a step hold structure is mounted to said climbing wall, said step hold having a generally flat top surface and wherein an instructional guide is provided to describe a workout routine.

18. The workout system of claim 17, wherein an activatable counter is mounted in said step hold to monitor step hold use during a workout routine.

19. The workout system of claim 17, wherein said step hold and said U-shaped hold structure are both utilized in a workout routine.

20. The workout system of claim 16, wherein said rigid climbing wall is comprised of a plurality of climbing wall panels and wherein each said panel has a specified workout routine.

* * * * *